US011408423B2

(12) United States Patent
Choi et al.

(10) Patent No.: US 11,408,423 B2
(45) Date of Patent: Aug. 9, 2022

(54) SCROLL COMPRESSOR

(71) Applicant: LG ELECTRONICS INC., Seoul (KR)

(72) Inventors: Yongkyu Choi, Seoul (KR); Kangwook Lee, Seoul (KR); Cheolhwan Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 71 days.

(21) Appl. No.: 16/655,587

(22) Filed: Oct. 17, 2019

(65) Prior Publication Data

US 2020/0049146 A1 Feb. 13, 2020

Related U.S. Application Data

(63) Continuation of application No. 15/491,051, filed on Apr. 19, 2017, now Pat. No. 10,648,470.

(30) Foreign Application Priority Data

Apr. 26, 2016 (KR) ..... 10-2016-0051046

(51) Int. Cl.
*F04C 18/02* (2006.01)
*F04C 28/28* (2006.01)
(Continued)

(52) U.S. Cl.
CPC ..... *F04C 18/0269* (2013.01); *F04C 18/0215* (2013.01); *F04C 28/28* (2013.01);
(Continued)

(58) Field of Classification Search
CPC .. F04C 18/0269; F04C 18/0215; F04C 28/28; F04C 18/0246; F04C 18/0223;
(Continued)

(56) References Cited

U.S. PATENT DOCUMENTS 5,318,424 A 6/1994 Bush et al.
5,395,222 A * 3/1995 Kawahara ..... F04C 18/0269 418/55.2
(Continued)

FOREIGN PATENT DOCUMENTS

CN 101395377 3/2009
CN 103814218 5/2014
(Continued)

OTHER PUBLICATIONS

International Search Report dated Jun. 7, 2017.
(Continued)

*Primary Examiner* — Deming Wan
(74) *Attorney, Agent, or Firm* — Ked & Associates LLP

(57) ABSTRACT

A scroll compressor is provided that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap. In a state in which the orbiting scroll and the fixed scroll are concentric with each other, when a distance between the orbiting wrap and the fixed wrap is defined as an orbiting radius, there exists an offset section having an interval larger than the orbiting radius, between a side surface of the orbiting wrap and a side surface of the fixed wrap which faces the orbiting wrap. With such a configuration, even if the fixed scroll or the orbiting scroll is transformed due to thermal expansion, interference between the fixed wrap and the orbiting wrap at a portion having a large transformation amount may be prevented. This may prevent a frictional loss or abrasion between the fixed wrap and the orbiting wrap. Further, this may restrict or minimize a gap between the fixed wrap and
(Continued)

the orbiting wrap at an opposite side to the suction chamber, resulting in enhanced compression efficiency.

12 Claims, 12 Drawing Sheets

(51) Int. Cl.

| | |
|---|---|
| ***F01C 1/02*** | (2006.01) |
| ***F04C 23/00*** | (2006.01) |
| *F04C 29/00* | (2006.01) |
| *F04C 29/12* | (2006.01) |

(52) U.S. Cl.
CPC ..... *F04C 29/0085* (2013.01); *F04C 29/12* (2013.01); *F04C 2240/30* (2013.01); *F04C 2240/60* (2013.01)

(58) Field of Classification Search
CPC .... F04C 23/008; F01C 1/0223; F01C 1/0246; F01C 1/0269; F01C 1/0284
See application file for complete search history.

(56) References Cited

U.S. PATENT DOCUMENTS

| | | | | |
|---|---|---|---|---|
| 5,413,469 | A | 5/1995 | Nakajima et al. | |
| 5,520,525 | A * | 5/1996 | Mizuno | F04C 18/0269 418/55.2 |
| 5,591,022 | A * | 1/1997 | Protos | F01C 17/00 418/55.2 |
| 5,938,417 | A | 8/1999 | Takao et al. | |
| 6,213,741 | B1 | 4/2001 | Mori et al. | |
| 6,648,617 | B2 * | 11/2003 | Suss | F04C 18/0269 418/1 |
| 9,163,632 | B2 | 10/2015 | Katou et al. | |
| 10,060,434 | B2 | 8/2018 | Deguchi et al. | |
| 2002/0071780 | A1 * | 6/2002 | Chang | F04C 18/0269 418/55.2 |
| 2004/0067147 | A1 * | 4/2004 | Nakane | F04C 29/04 418/55.2 |
| 2004/0101428 | A1 | 5/2004 | Shibamoto et al. | |
| 2006/0115371 | A1 | 6/2006 | Hiwata et al. | |
| 2015/0369244 | A1 | 12/2015 | Stoop et al. | |
| 2016/0053759 | A1 | 2/2016 | Choi et al. | |
| 2019/0072092 | A1 | 3/2019 | Kim et al. | |

FOREIGN PATENT DOCUMENTS

| | | | | |
|---|---|---|---|---|
| CN | 105264231 | | 1/2016 | |
| CN | 105370571 | | 3/2016 | |
| EP | 0 275 415 | | 7/1988 | |
| EP | 2 143 950 | | 1/2010 | |
| GB | 2 200 408 | | 8/1988 | |
| JP | 60-79189 | | 5/1985 | |
| JP | H 08-004669 | | 1/1996 | |
| JP | 2971739 | | 11/1999 | |
| JP | 2001-020878 | | 1/2001 | |
| JP | 2007-278271 | | 10/2007 | |
| JP | 2008-163895 | | 7/2008 | |
| JP | 2009-174406 | | 8/2009 | |
| JP | 2010-248994 | | 11/2010 | |
| JP | 2010-248995 | | 11/2010 | |
| JP | 2013036366 | A * | 2/2013 | F04C 18/0215 |
| KR | 10-2009-0012618 | | 2/2009 | |
| KR | 10-2014-0063830 | | 5/2014 | |
| KR | 10-2014-0144032 | | 12/2014 | |
| KR | 10-2016-0022146 | | 2/2016 | |
| WO | WO 2014/134961 | | 3/2014 | |

OTHER PUBLICATIONS

International Search Report dated Jun. 9, 2017.
European Search Report dated Aug. 4, 2017 issued in Application No. 17165725.7.
European Search Report dated Oct. 6, 2017 issued in Application No. 17166246.3.
Chinese Office Action dated Jul. 31, 2018 (with English Translation).
Chinese Office Action dated Sep. 27, 2018 issued in Application No. 201710236347.X (with English Translation).
United States Office Action dated Mar. 28, 2019 issued in U.S. Appl. No. 15/491,051.
United States Office Action issued in U.S. Appl. No. 15/491,023 dated Apr. 3, 2019.
Chinese Office Action dated Jun. 19, 2019 (with English Translation).
United States Notice of Allowance issued in U.S. Appl. No. 15/491,023 dated Sep. 11, 2019.
United States Office Action dated Sep. 20, 2019 issued in U.S. Appl. No. 15/491,051.
European Search Report dated Feb. 20, 2020.
U.S. Appl. No. 16/693,450, filed Nov. 25, 2019.
U.S. Appl. No. 15/491,051, filed Apr. 19, 2017.
U.S. Appl. No. 16/655,587, filed Oct. 17, 2019.
U.S. Notice of Allowance issued in U.S. Appl. No. 15/491,051 dated Jan. 23, 2020.

* cited by examiner

SCROLL COMPRESSOR

CROSS-REFERENCE TO RELATED APPLICATION(S)

This application is a Continuation Application of prior U.S. patent application Ser. No. 15/491,051 filed Apr. 19, 2017, which claims priority under 35 U.S.C. § 119 to Korean Patent Application No. 10-2016-0051046 filed on Apr. 26, 2016, whose entire disclosures are hereby incorporated by reference.

BACKGROUND

1. Field

A scroll compressor is disclosed herein.

2. Background

Generally, a scroll compressor is being widely used in air conditioners, for example, in order to compress a refrigerant, owing to its advantages that a compression ratio is relatively higher than that of other types of compressors, and a stable torque is obtainable as processes for suction, compressing, and discharging a refrigerant are smoothly performed. A behavior characteristic of the scroll compressor is determined by a non-orbiting wrap (hereinafter, referred to as a "fixed wrap") of a non-orbiting scroll (hereinafter, referred to as a "fixed scroll") and an orbiting wrap of an orbiting scroll. The fixed wrap and the orbiting wrap may have any shape, but they generally have a shape of an involute curve for easy processing. The involute curve means a curved line corresponding to a moving path drawn by the end of a thread when the thread wound around a basic circle having any radius is unwound. In a case of using such an involute curve, the fixed wrap and the orbiting wrap stably perform a relative motion since they have a constant thickness, thereby forming a compression chamber to compress a refrigerant.

As a volume of the compression chamber of the scroll compressor is decreased towards an inner side from an outer side, a suction chamber is formed at the outer side and a discharge chamber is formed at the inner side. A refrigerant suctioned into the suction chamber has a temperature of about 18° C., and a refrigerant discharged from the discharge chamber has a temperature of about 80° C. However, the orbiting scroll is not greatly influenced by a refrigerant discharge temperature, as a rear surface thereof is positioned between the orbiting scroll and the fixed scroll in a supported state by a main frame. On the other hand, the fixed scroll is exposed to a refrigerant discharge temperature as a plate portion or plate, which forms a rear surface thereof is coupled to an inner space of a casing or a discharge cover or a high and low pressure separation plate.

As the rear surface of the fixed scroll is exposed to a refrigerant discharge temperature, the plate portion of the fixed scroll is entirely influenced by the refrigerant discharge temperature to be thermally-expanded. On the other hand, a fixed wrap, provided on one side surface of the plate portion of the fixed scroll and forming the compression chamber, is not entirely influenced by a refrigerant discharge temperature. More specifically, a part or portion of the fixed wrap near a suction chamber is influenced by a suction temperature, a part or portion of the fixed wrap near an intermediate pressure chamber is influenced by an intermediate compression temperature, and a part or portion of the fixed wrap near a discharge chamber is influenced by a discharge temperature. That is, the fixed wrap has a different thermal expansion rate according to a region. As the plate portion of the fixed scroll is more thermally-transformed than the fixed wrap, the fixed wrap is transformed in a contracted shape.

Especially, as the fixed wrap near the suction chamber directly contacts a cold suction refrigerant having a temperature of about 18° C., the fixed wrap near the suction chamber is more transformed than other regions, because it has a tendency to be contracted towards a central region. This may cause an orbiting wrap contacting the fixed wrap formed near the suction chamber, to be pushed by the bent fixed wrap. As a result, the orbiting wrap having a crank angle of 180° at an opposite side is spaced from the fixed wrap, resulting in a compression loss.

Further, as a specific region of the fixed wrap is more thermally-transformed than other regions, the fixed wrap and the orbiting wrap may excessively contact each other. This may increase a frictional loss or abrasion between the fixed scroll and the orbiting scroll.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a scroll compressor according to embodiments will be explained in more detail with reference to the attached drawings. For reference, the scroll compressor according to embodiments is to prevent interference between a fixed wrap and an orbiting wrap at a region near a suction chamber, due to a non-uniform thermal transformation of a fixed scroll, by forming a wrap thickness of the fixed wrap near the suction chamber to be large. Thus, the embodiments may be applied to any type of scroll compressor having a fixed wrap and an orbiting wrap. However, for convenience, a lower compression type scroll compressor where a compression part or device is disposed below a motor part or motor, more specifically, a scroll compressor where a rotational shaft is overlapped with an orbiting wrap on a same plane will be explained. Such a scroll compressor is appropriate to be applied to a refrigerating cycle of a high temperature and a high compression ratio.

Figure 1:
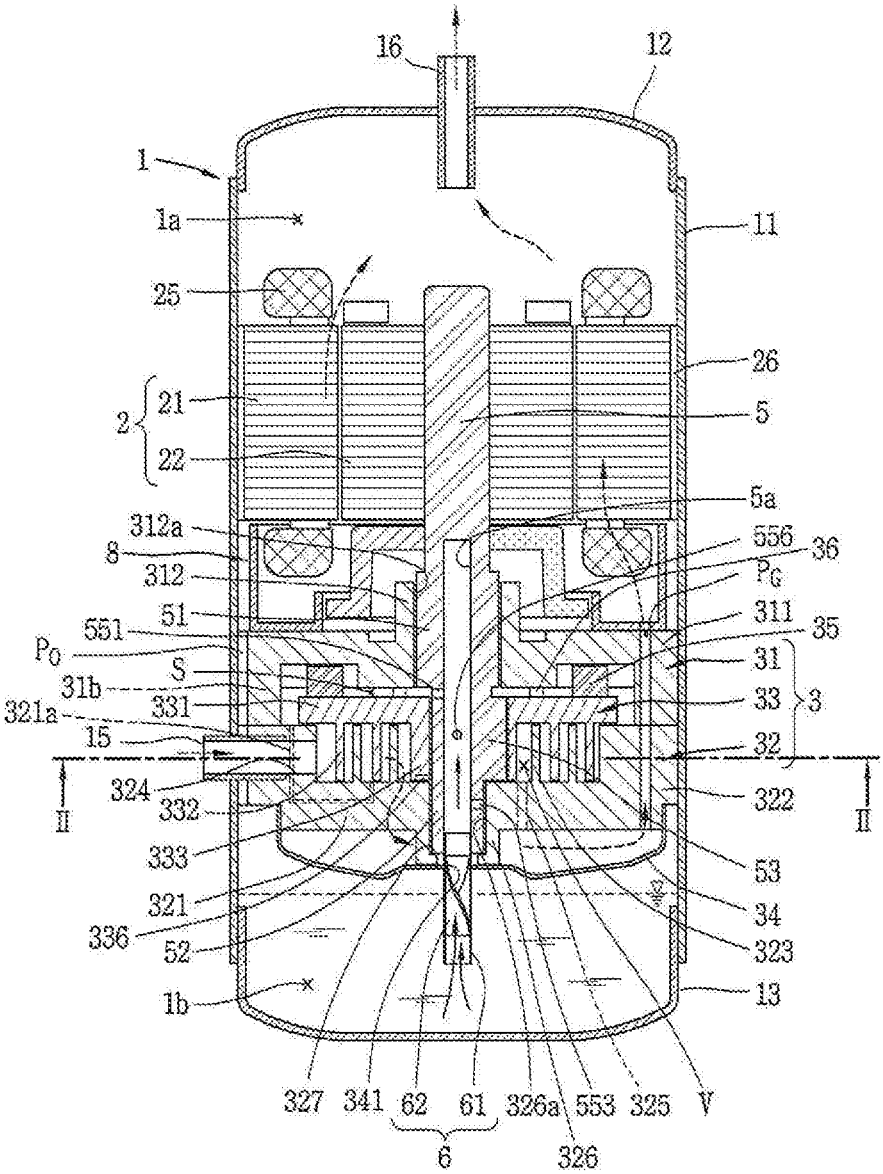
FIG. 1 is a longitudinal cross-sectional view illustrating an example of a lower compression type scroll compressor according an embodiment.
Figure 2:
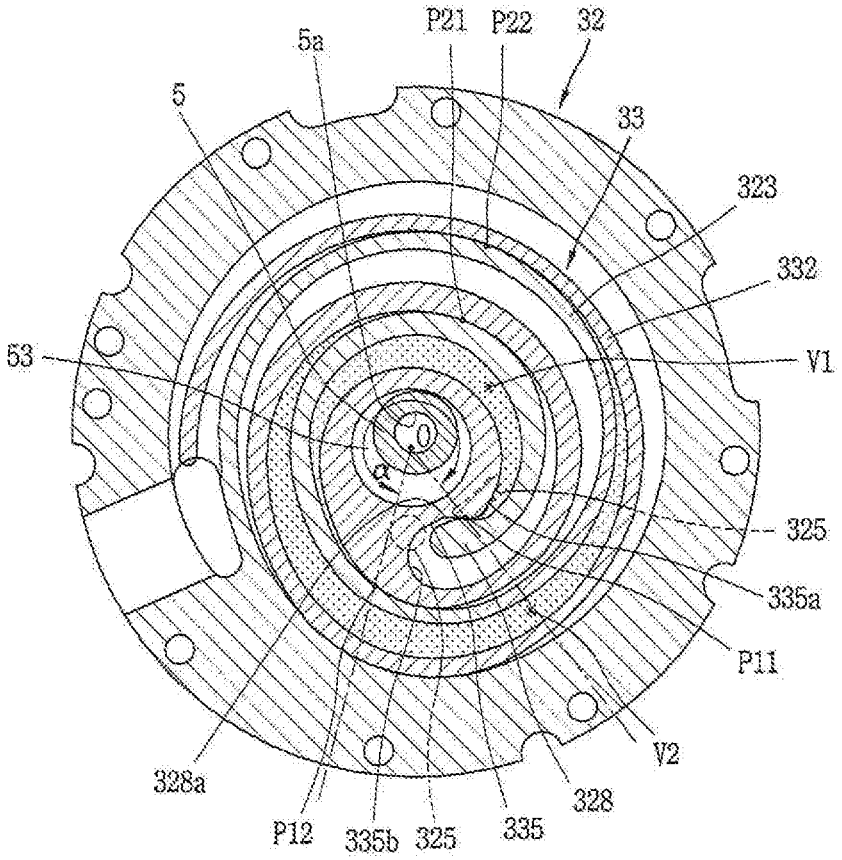
FIG. 2 is a sectional view taken along line 'II-II' in FIG. 1.

FIG. 1 is a longitudinal sectional view illustrating an example of a lower compression type scroll compressor according to an embodiment. FIG. 2 is a sectional view taken along line 'II-II' in FIG. 1.

Referring to FIG. 1, the lower compression type scroll compressor according to this embodiment may include a casing 1 having an inner space 1*a*; a motor part or motor 2 provided at the inner space 1*a* of the casing 1 and configured to generate a rotational force, in the form of a drive motor; a compression part or device 3 disposed or provided below the motor part 2, and configured to compress a refrigerant by receiving the rotational force of the motor part 2. The casing 1 may include a cylindrical shell 11 which forms a hermetic container; an upper shell 12 which forms the hermetic container together by covering an upper part or portion of the cylindrical shell 11; and a lower shell 13 which forms the hermetic container together by covering a lower part or portion of the cylindrical shell 11, and which forms an oil storage space 1*b*.

A refrigerant suction pipe 15 may be penetratingly-formed at a side surface of the cylindrical shell 11, thereby directly communicating with a suction chamber of the compression part 3. A refrigerant discharge pipe 16 that communicates with the inner space 1*a* of the casing 1 may be installed or provided at an upper part or portion of the upper shell 12. The refrigerant discharge pipe 16 may be a passage along which a refrigerant compressed by the compressor part 3 and discharged to the inner space 1*a* of the casing 1 may be discharged to the outside. An oil separator (not shown) that separates oil mixed with the discharged refrigerant may be connected to the refrigerant discharge pipe 16.

A stator 21 which constitutes or forms the motor part 2 may be installed or provided at an upper part or portion of the casing 1, and a rotor 22 which constitutes or forms the motor part 2 together with the stator 21 and rotated by a reciprocal operation with the stator 21 may be rotatably installed or provided in the stator 21. A plurality of slots (not shown) may be formed on an inner circumferential surface of the stator 21 in a circumferential direction, on which a coil 25 may be wound. An oil collection passage 26 configured to pass oil therethrough may be formed between an outer circumferential surface of the stator 21 and an inner circumferential surface of the cylindrical shell 11, in a D-cut shape.

A main frame 31 which constitutes or forms the compression part 3 may be fixed to an inner circumferential surface of the casing 1, below the stator 21 with a predetermined gap therebetween. The main frame 31 may be coupled to the cylindrical shell 11 as an outer circumferential surface of the main frame 31 is welded or shrink-fit to an inner circumferential surface of the cylindrical shell 11.

A ring-shaped frame side wall portion or side wall (first side wall portion or side wall) 311 may be formed at an edge of the main frame 31, and a first shaft accommodating portion 312 configured to support a main bearing portion 51 of a rotational shaft 5, which is discussed hereinafter, may be formed at a central part or portion of the main frame 31. A first shaft accommodating hole 312*a*, configured to rotatably insert the main bearing portion 51 of the rotational shaft 5 and support the main bearing portion 51 in a radial direction, may be penetratingly-formed at the first shaft accommodating portion 312 in an axial direction.

A fixed scroll 32 may be installed or provided at a bottom surface of the main frame 31, in a state in which an orbiting scroll 33 eccentrically-coupled to the rotational shaft 5 is disposed between the fixed scroll 32 and the main frame 31. The fixed scroll 32 may be fixedly-coupled to the main frame 31, and may be fixed to the main frame 31 so as to be moveable in the axial direction.

The fixed scroll 32 may include a fixed plate portion or plate (hereinafter, referred to as a "first plate portion" or first "plate") 321 formed in an approximate disc shape, and a scroll side wall portion or side wall (hereinafter, referred to as a "second side wall portion" of "second side wall") 322 formed at an edge of the first plate portion 321 and coupled to an edge of a bottom surface of the main frame 31. A fixed wrap 323, which forms a compression chamber (V) by being engaged with an orbiting wrap 332, which is discussed hereinafter, may be formed on an upper surface of the first plate portion 321. The compression chamber (V) may be formed between the first plate portion 321 and the fixed wrap 323, and between the orbiting wrap 332, which is discussed hereinafter, and the second plate portion 331. The compression chamber (V) may include a suction chamber, an intermediate pressure chamber, and a discharge chamber consecutively formed in a moving direction of the wrap.

The compression chamber (V) may include a first compression chamber (V1) formed between an inner side surface of the fixed wrap 323 and an outer side surface of the orbiting wrap 332, and a second compression chamber (V2) formed between an outer side surface of the fixed wrap 323 and an inner side surface of the orbiting wrap 332. That is, as shown in FIG. 2, the first compression chamber (V1) may be formed between two contact points (P11, P12) generated as the inner side surface of the fixed wrap 323 and the outer side surface of the orbiting wrap 332 come in contact with each other. Under an assumption that a largest angle among angles formed by two lines which connect a center (O) of an eccentric portion with two contact points (P11, P12) is $\alpha$, a formula ($\alpha<360°$) is formed before a discharge operation is started. The second compression chamber (V2) may be formed between two contact points (P21, P22) generated as the outer side surface of the fixed wrap 323 and the inner side surface of the orbiting wrap 332 come in contact with each other.

The first compression chamber (V1) is formed such that a refrigerant is firstly suctioned thereinto prior to being suctioned into the second compression chamber (V2), and such that a compression path thereof is relatively long. However, as the orbiting wrap 332 is formed with irregularity, a compression ratio of the first compression chamber (V1) is lower than a compression ratio of the second compression chamber (V2). Further, the second compression chamber (V2) is formed such that a refrigerant is later suctioned thereinto after being suctioned into the first compression chamber (V1), and such that a compression path thereof is relatively short. However, as the orbiting wrap 332 is formed with irregularity, the compression ratio of the second compression chamber (V2) is higher than the compression ratio of the first compression chamber (V1).

An inlet 324, through which a refrigerant suction pipe 15 and a suction chamber may communicate with each other, may be penetratingly-formed at one side of the second side wall portion 322. An outlet 325, that communicates with a discharge chamber and through which a compressed refrigerant may be discharged, may be formed at a central part or portion of the first plate portion 321. The outlet 325 may be formed as one outlet that communicates with both of the first and second compression chambers (V1, V2). Alternatively, a plurality of the outlet 325 may be formed so as to communicate with the first and second compression chambers (V1, V2).

A second shaft accommodation portion 326, configured to support a sub bearing portion 52 of the rotational shaft 5, which is discussed hereinafter, may be formed at a central part or portion of the first plate portion 321 of the fixed scroll 32. A second shaft accommodating hole 326*a*, configured to support the sub bearing portion 52 in the radial direction, may be penetratingly-formed at the second shaft accommodating portion 326 in the axial direction.

A thrust bearing portion 327, configured to support a lower end surface of the sub bearing portion 52 in the axial direction, may be formed at a lower end of the second shaft accommodation portion 326. The thrust bearing portion 327 may protrude from a lower end of the second shaft accommodating hole 326*a* in the radial direction, towards a shaft center. However, the thrust bearing portion may be formed between a bottom surface of an eccentric portion 53 of the rotational shaft 5, which is discussed hereinafter, and the first plate portion 321 of the fixed scroll 32 corresponding thereto.

A discharge cover 34, configured to accommodate a refrigerant discharged from the compression chamber (V) therein and to guide the refrigerant to a refrigerant passage, which is discussed hereinafter, may be coupled to a lower side of the fixed scroll 32. The discharge cover 34 may be formed such that an inner space thereof may accommodate therein the discharge opening 325 and may accommodate therein an inlet of the refrigerant passage ($P_G$) along which a refrigerant discharged from the compression chamber (V1) may be guided to the inner space 1*a* of the casing 1.

The refrigerant passage ($P_G$) may be penetratingly-formed at the second side wall portion 322 of the fixed scroll 32 and the first side wall portion 311 of the main frame 31, sequentially, at an inner side of an oil passage separation portion 8. Alternatively, the refrigerant passage ($P_G$) may be formed so as to be consecutively recessed from an outer circumferential surface of the second side wall portion 322 and an outer circumferential surface of the first frame 311.

The orbiting scroll 33 may be installed or provided between the main frame 31 and the fixed scroll 32 so as to perform an orbiting motion. An Oldham's ring 35 to prevent rotation of the orbiting scroll 33 may be installed or provided between an upper surface of the orbiting scroll 33 and a bottom surface of the main frame 31 corresponding thereto, and a sealing member 36, which forms a back pressure chamber (S), may be installed or provided at an inner side than the Oldham's ring 35. Thus, the back pressure chamber (S) may be implemented as a space formed by the main frame 31, the fixed scroll 32, and the orbiting scroll 33, outside of the sealing member 36. The back pressure chamber (S) forms an intermediate pressure because a refrigerant of an intermediate pressure is filled therein as the back pressure chamber (S) communicates with the intermediate compression chamber (V) by a back pressure hole 321*a* provided at the fixed scroll 32. However, a space formed at an inner side than the sealing member 36 may also serve as a back pressure chamber as oil of high pressure is filled therein.

An orbiting plate portion or orbiting plate (hereinafter, referred to as a "second plate portion" or "second plate") 331 of the orbiting scroll 33 may be formed to have an approximate disc shape. The back pressure chamber (S) may be formed at an upper surface of the second plate portion 331, and the orbiting wrap 332, which forms the compression chamber by being engaged with the fixed wrap 322, may be formed at a bottom surface of the second plate portion 331.

The eccentric portion 53 of the rotational shaft 5, which is discussed hereinafter, may be rotatably inserted into a central part or portion of the second plate portion 331, such that a rotational shaft coupling portion 333 may pass therethrough in the axial direction.

The rotational shaft coupling portion 333 may be extended from the orbiting wrap 332 so as to form an inner end of the orbiting wrap 332. Thus, as the rotational shaft coupling portion 333 is formed to have a height high enough to be overlapped with the orbiting wrap 332 on a same plane, the eccentric portion 53 of the rotational shaft 5 may be overlapped with the orbiting wrap 332 on the same plane. With such a configuration, a repulsive force and a compressive force of a refrigerant may be applied to the same plane on the basis of the second plate portion to be attenuated from each other. This may prevent a tilted state of the orbiting scroll 33 due to the compressive force and the repulsive force.

An outer circumference of the rotational shaft coupling portion 333 may be connected to the orbiting wrap 332 to form the compression chamber (V) during a compression operation together with the fixed wrap 322. The orbiting wrap 332 may be formed to have an involute shape together with the fixed wrap 323. However, the orbiting wrap 332 may be formed to have various shapes. For example, as shown in FIG. 2, the orbiting wrap 332 and the fixed wrap 323 may be formed to have a shape implemented as a plurality of circles of different diameters and origin points may be connected to each other, and a curved line of an outermost side may be formed as an approximate oval having a long axis and a short axis.

A protrusion 328 that protrudes toward an outer circumference of the rotational shaft coupling portion 333, may be formed near an inner end (a suction end or a starting end) of the fixed wrap 323. A contact portion 328*a* may protrude from the protrusion 328. That is, the inner end of the fixed wrap 323 may be formed to have a greater thickness than other parts. With such a configuration, the inner end of the fixed wrap 323, having the largest compressive force among other parts of the fixed wrap 323, may have an enhanced wrap intensity and may have enhanced durability.

A concaved portion 335, engaged with the protrusion 328 of the fixed wrap 323, may be formed at an outer circumference of the rotational shaft coupling portion 333 which is opposite to the inner end of the fixed wrap 323. A thickness increase portion 335*a*, having its thickness increased from an inner circumferential part or portion of the rotational shaft coupling portion 333 to an outer circumferential part or portion thereof, may be formed at one side of the concaved portion 335, at an upstream side in a direction to form the compression chambers (V). This may enhance a compression ratio of the first compression chamber (V1) by shortening a length of the first compression chamber (V1) prior to a discharge operation.

A circular arc surface 335*b* having a circular arc shape may be formed at another side of the concaved portion 335. A diameter of the circular arc surface 335*b* may be determined by a thickness of the inner end of the fixed wrap 323 and an orbiting radius of the orbiting wrap 332. If the thickness of the inner end of the fixed wrap 323, the diameter of the circular arc surface 335*b* is increased. This may allow the orbiting wrap around the circular arc surface 335*b* to have an increased thickness and thus to obtain durability. Further, as a compression path becomes longer, a compression ratio of the second compression chamber (V2) may be increased in correspondence thereto.

The rotational shaft 5 may be supported in the radial direction as an upper part or portion thereof is forcibly-coupled to a central part or portion of the rotor 22, and as a lower part or portion thereof is coupled to the compression part 3. Thus, the rotational shaft 5 transmits a rotational force of the motor part 2 to the orbiting scroll 33 of the compression part 3. As a result, the orbiting scroll 33 eccentrically-coupled to the rotational shaft 5 performs an orbiting motion with respect to the fixed scroll 32.

The main bearing portion 51, supported in the radial direction by being inserted into the first shaft accommodating hole 312*a* of the main frame 31, may be formed at a lower part or portion of the rotational shaft 5. The sub bearing portion 52, supported in the radial direction by being inserted into the second shaft accommodating hole 326*a* of the fixed scroll 32, may be formed below the main bearing portion 51. The eccentric portion 53, inserted into the rotational shaft coupling portion 333 of the orbiting scroll 33, may be formed between the main bearing portion 51 and the sub bearing portion 52.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be smaller than a diameter of the main bearing portion 51, but larger than a diameter of the sub bearing portion 52, such that the rotational shaft 5 may be easily coupled to the eccentric portion 53 through the shaft accommodating holes 312*a*, 326*a*, and the rotational shaft coupling portion 333. However, in a case of forming the eccentric portion 53 using an additional bearing without integrally forming the eccentric portion 53 with the rotational shaft 5, the rotational shaft 5 may be coupled to the eccentric portion 53, without the configuration that the outer diameter of the eccentric portion 53 is larger than the diameter of the sub bearing portion 52.

An oil supply passage 5*a*, along which oil may be supplied to the bearing portions and the eccentric portion, may be formed in the rotational shaft 5. As the compression part 3 is disposed below the motor part 2, the oil supply passage 5*a* may be formed in a chamfering manner from a lower end of the rotational shaft 5 to a lower end of the stator 21 or to an intermediate height of the stator 21, or to a height higher than an upper end of the main bearing portion 51.

An oil feeder 6, configured to pump oil contained in the oil storage space 1*b*, may be coupled to a lower end of the rotational shaft 5, that is, a lower end of the sub bearing portion 52. The oil feeder 6 may include an oil supply pipe 61 insertion-coupled to the oil supply passage 5*a* of the rotational shaft 5, and an oil suctioning member 62, for example, propeller, inserted into the oil supply pipe 61 and configured to suction oil. The oil supply pipe 61 may be installed or provided to be immersed in the oil storage space 1*b* via a though hole 341 of the discharge cover 34.

An oil supply hole and/or an oil supply groove, configured to supply oil suctioned through the oil supply passage to an outer circumferential surface of each of the respective bearing portions and the eccentric portion, may be formed at the respective bearing portions and the eccentric portion, or at a position between the respective bearing portions. Thus, oil suctioned toward an upper end of the main bearing portion 51 along the oil supply passage 5*a* of the rotational shaft 5, an oil supply hole (not shown) and an oil supply groove (not shown), flows out of bearing surfaces from an upper end of the first shaft accommodating portion 312 of the main frame 31. Then, the oil flows down onto an upper surface of the main frame 31, along the first shaft accommodating portion 312. Then, the oil is collected in the oil storage space 1*b*, through an oil passage ($P_O$) consecutively formed on an outer circumferential surface of the main frame 31 (or through a groove that communicates or extends from the upper surface of the main frame 31 to the outer circumferential surface of the main frame 31) and an outer circumferential surface of the fixed scroll 32.

Further, oil, discharged to the inner space 1*a* of the casing 1 from the compression chamber (V) together with a refrigerant, may be separated from the refrigerant at an upper space of the casing 1. Then, the oil may be collected in the oil storage space 1*b*, through a passage formed on an outer circumferential surface of the motor part 2, and through the oil passage ($P_O$) formed on an outer circumferential surface of the compression part 3.

The lower compression type scroll compressor according to an embodiment may be operated as follows.

Firstly, once power is supplied to the motor part 2, the rotor 21, and the rotational shaft 5 may be rotated as a rotational force is generated. As the rotational shaft 5 is rotated, the orbiting scroll 33 eccentrically-coupled to the rotational shaft 5 may perform an orbiting motion by the Oldham's ring 35.

As a result, the refrigerant supplied from outside of the casing 1 through the refrigerant suction pipe 15 may be introduced into the compression chambers (V), and the refrigerant compressed as a volume of the compression chambers (V) is reduced by the orbiting motion of the orbiting scroll 33. Then, the compressed refrigerant may be discharged to an inner space of the discharge cover 34 through the discharge opening 325.

The refrigerant discharged to the inner space of the discharge cover 34 may circulate at the inner space of the discharge cover 34, thereby having its noise reduced. Then, the refrigerant may move to a space between the main frame 31 and the stator 21, and move to an upper space of the motor part 2 through a gap between the stator 21 and the rotor 22.

The refrigerant may have oil separated therefrom at the upper space of the motor part 2, and then be discharged to the outside of the casing 1 through the refrigerant discharge pipe 16. On the other hand, the oil may be collected in the oil storage space, a lower space of the casing 1, through a flow path between an inner circumferential surface of the casing 1 and the stator 21, and through a flow path between the inner circumferential surface of the casing 1 and an outer circumferential surface of the compression part 3. Such processes may be repeatedly performed.

The compression chamber (V) formed between the fixed scroll 32 and the orbiting scroll 33 has a suction chamber at an edge region, and has a discharge chamber at a central region on the basis of the orbiting scroll 33. As a result, the fixed scroll 32 and the orbiting scroll 33 may have a highest temperature at the central region, and have a lowest temperature at the edge region. Especially, a suction refrigerant temperature is about 18° C. at the suction chamber, whereas a discharge refrigerant temperature is about 80° C. at the discharge chamber. This may cause a temperature around the suction chamber to be much lower than a temperature around the discharge chamber.

However, a high temperature refrigerant discharged from the discharge chamber spreads to an entire region of an inner space of the discharge cover 34, thereby contacting a rear surface of the first plate portion 321 of the fixed scroll 32 which forms the inner space of the discharge cover 34. As a result, the first plate portion 321 of the fixed scroll 32 has a tendency to expand to an edge region by receiving heat from the high temperature refrigerant. On the other hand, the fixed wrap 323, far from the inner space of the discharge cover 34, has a smaller tendency to expand than the first plate portion 321. Due to such a thermal transformation difference, the fixed scroll 32 is transformed in a shape to contract in a wrap direction. Especially, the fixed wrap near the suction chamber is much influenced by a suction refrigerant temperature than the fixed wrap at another region, thereby having a tendency to contract. This may cause an end of the fixed wrap near the suction chamber to be more contracted (more transformed) than the fixed wrap which is positioned at an opposite side to the suction chamber.

As a result, as the orbiting scroll 33 is pushed in an opposite direction to the suction chamber, a gap may occur between a side surface of the orbiting wrap 332 and a side surface of the fixed wrap 323. This may cause the compression chamber (V) not to be sealed due to the gap, resulting in a compression loss or a frictional loss between the wraps and abrasion.

Figure 3:
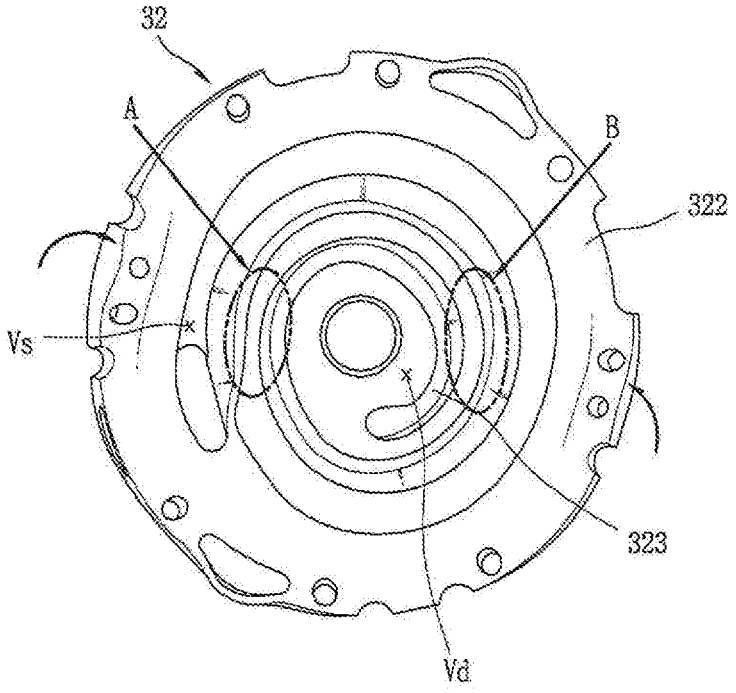
FIG. 3 is a planar view illustrating a thermally-deformed state of a fixed scroll in the scroll compressor of FIG. 1.
Figure 4:
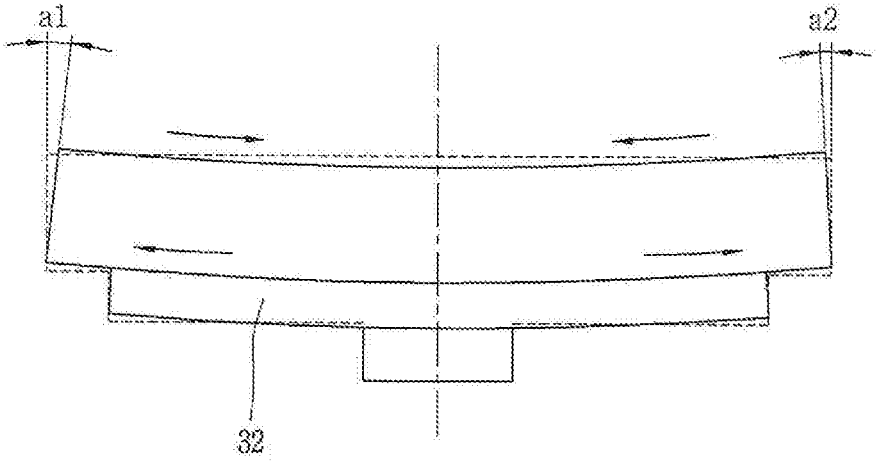
FIG. 4 is a frontal schematic view of the fixed scroll of FIG. 3.
Figure 5:
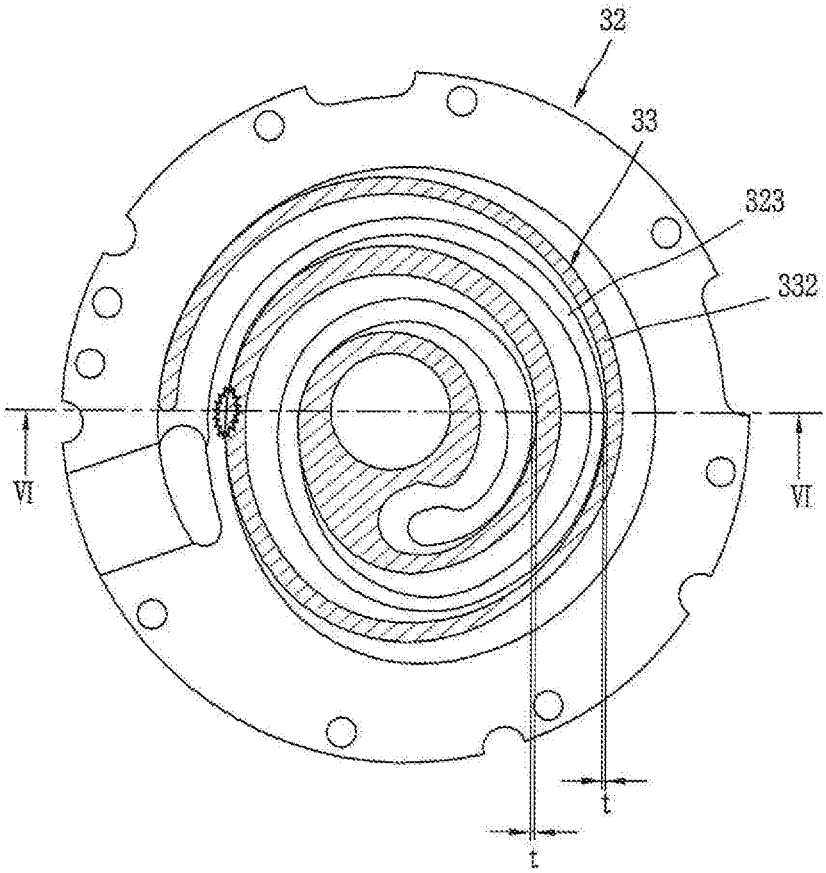
FIG. 5 is a sectional view illustrating a partial interference between a fixed wrap and an orbiting wrap, in a coupled state of an orbiting scroll to the fixed scroll of FIG. 3.
Figure 6:
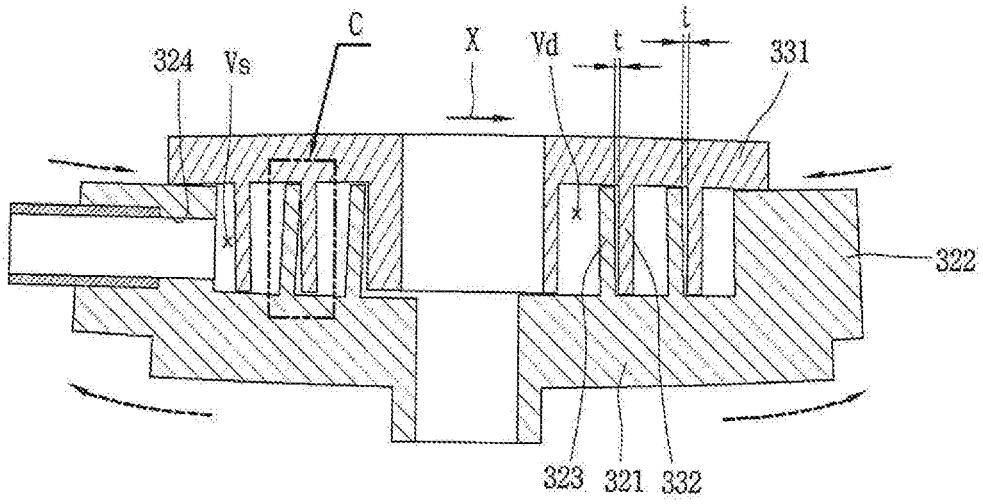
FIG. 6 is a sectional view taken along line 'VI-VI' in FIG. 5.
Figure 7:
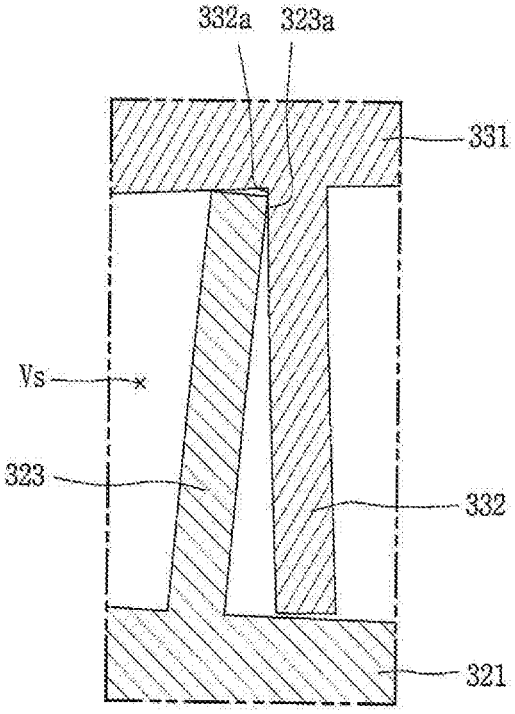
FIG. 7 is a sectional view which illustrates part C" of FIG. 6 in an enlarged manner.

FIG. 3 is a planar view illustrating a thermally-deformed state of a fixed scroll in the scroll compressor of FIG. 1. FIG. 4 is a frontal schematic view of the fixed scroll of FIG. 3. FIG. 5 is a sectional view illustrating a partial interference between a fixed wrap and an orbiting wrap, in a coupled state of an orbiting scroll to the fixed scroll of FIG. 3. FIG. 6 is a sectional view taken along line 'VI-VI' in FIG. 5. FIG. 7 is a sectional view which illustrates part C" of FIG. 6 in an enlarged manner.

As shown, the first plate portion 321 of the fixed scroll 32 is bent towards an upper side, that is, an opposite direction to a contact surface with the discharge cover 34. A region (A) near the suction chamber (Vs) is more bent than an opposite region (crank angle of 180°) (B) by a predetermined angle ($\alpha$1-$\alpha$2).

On the other hand, as a rear surface of the second plate portion 331 contacts the back pressure chamber (S), which forms an intermediate pressure, the orbiting scroll 33 is less transformed than the fixed scroll 32, as shown in FIGS. 5 and 6. As a result, as shown in FIG. 7, an edge of an end 323*a* of the fixed wrap 323 may interfere with a side surface of a root 332*a* of the orbiting wrap 332 contacting right side of the second plate portion 331. Accordingly, the orbiting scroll 33 is pushed to the side (the right side in the drawing), an opposite side to the suction chamber on the basis of a center of the fixed scroll (X). If the orbiting scroll 33 is pushed with respect to the fixed scroll 32 in the radial direction, a gap (t) occurs between a side surface of the orbiting wrap 332 and a side surface of the fixed wrap 323. This may cause a compression loss.

Considering this, in this embodiment, an offset portion is provided which forms an offset section, near the suction chamber of the fixed wrap and the suction chamber of the orbiting wrap corresponding thereto. With such a configuration, even if the fixed scroll and the orbiting scroll are thermally transformed, interference between the fixed wrap and the orbiting wrap may be prevented from occurring near the suction chamber. This may prevent leakage of a compressed refrigerant, occurring at an opposite side to the suction chamber as the fixed wrap and the orbiting wrap are spaced from each other.

Figure 8:
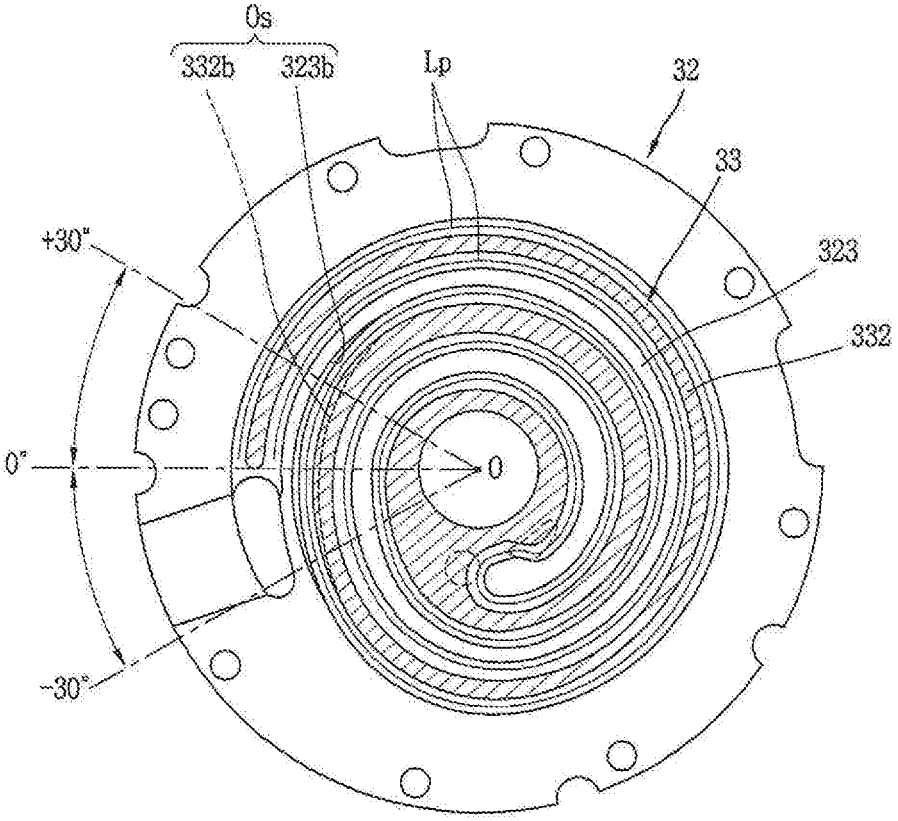
FIG. 8 is a planar view illustrating a coupled state of a fixed scroll and an orbiting scroll each having an offset portion, in a concentric state of the fixed scroll and the orbiting scroll in a scroll compressor according to an embodiment.
Figure 9:
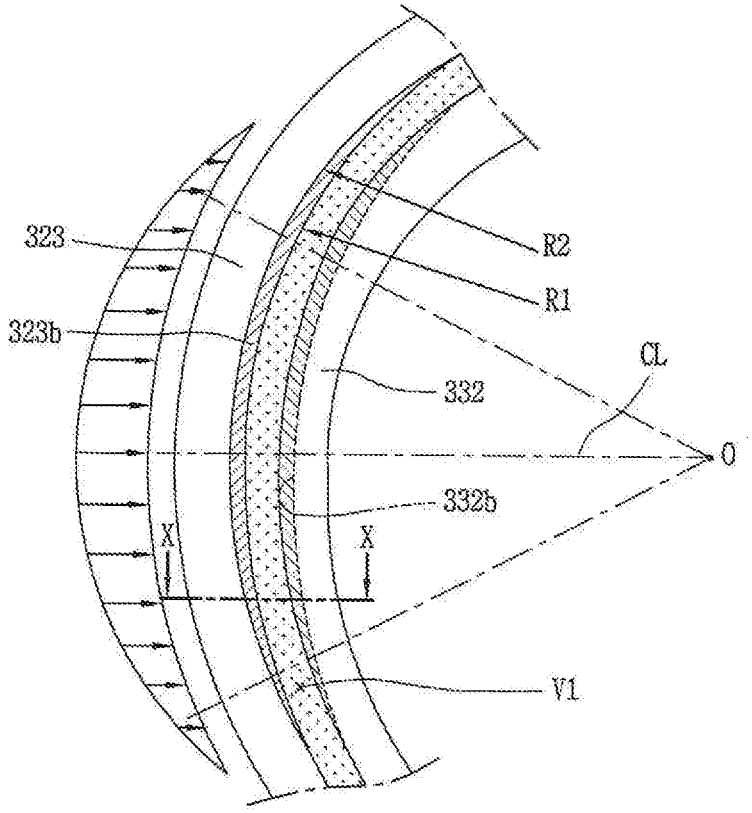
FIG. 9 is a planar view illustrating an offset portion according to this embodiment in an enlarged manner.
Figure 10:
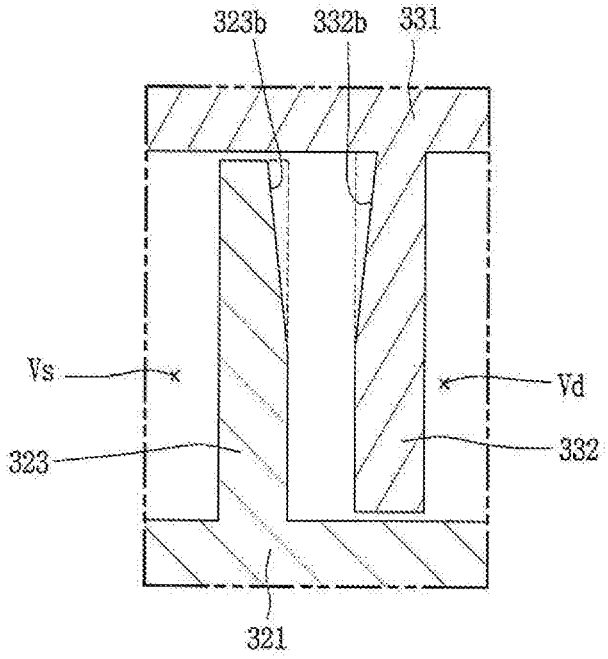
FIG. 10 is a sectional view taken along line 'X-X' in FIG. 9.

FIG. 8 is a planar view illustrating a coupled state of the fixed scroll and the orbiting scroll each having an offset portion, in a concentric state of the fixed scroll and the orbiting scroll in the scroll compressor according to an embodiment. FIG. 9 is a planar view illustrating an offset portion according to this embodiment in an enlarged manner. FIG. 10 is a sectional view taken along line 'X-X' in FIG. 9.

As shown in FIG. 8, an offset portion (Os) may be formed at each of the fixed wrap 323 and the orbiting wrap 332. The offset portion formed at the fixed wrap 323 may be referred to as a 'first offset portion', and the offset portion formed at the orbiting wrap 332 may be referred to as a 'second offset portion'. The first offset portion 323*b* may be formed at a region including at least part or portion of a section of the fixed wrap 323 which forms the suction chamber (Vs), and the second offset portion 332*b* may be formed at a region including at least part or portion of a section of the orbiting wrap 332 which forms the suction chamber (Vs).

The first offset portion 323*b* may be formed within a range of ±30° from a center (O) of the fixed scroll 32, on the basis of a suction completion point of the fixed wrap 323. The second offset portion 332*b* may be formed at the orbiting wrap 332 within a range corresponding to the first offset portion 323*b* of the fixed wrap 323.

The suction completion point means a region at which suction at the first compression chamber (V1) formed by an inner side surface of the fixed wrap 323 is completed, that is, a time point when a suction end of the orbiting wrap 332 contacts an inner side surface of the fixed wrap 323. In this case, a crank angle is 0° (zero).

When the crank angle is −30°, an angle is formed between a virtual line which connects the center (O) of the fixed scroll 32 with the suction completion point, and a farthest side wall surface of the inlet 324 that is, a farthest point in an opposite direction to a compression direction.

A proper offset amount of the offset portion (Os) is a value which satisfies [a thermal expansion coefficient ($\alpha$) of a material of the scroll×a distance (L) from a center of the scroll to the offset portion×a temperature difference ($\Delta$T) between a suction refrigerant and a discharge refrigerant]. For example, it is assumed that a refrigerant suction temperature is within a range of −40~30° C., a refrigerant discharge temperature is within a range of 35~140° C., the distance (L) is 32 mm, the thermal expansion coefficient ($\alpha$) is 1×10-5/° C., and the temperature difference ($\Delta$T) is within a range of 5° C.×180° C. In this case, as a minimum offset amount is [1×10-5×32×5=0.0016 mm], the proper offset amount is about 2 μm. Further, as a maximum offset amount is [1×10-5×32×180=0.0576 mm], the proper offset amount is about 58 μm. Accordingly, the proper offset amount ($\delta$) is within a range of 2 μm≤$\delta$≤58 μm.

If an actual offset amount is smaller than the proper offset amount, interference between the fixed wrap 323 and the orbiting wrap 332 may occur near the suction chamber. In this case, at an opposite side to the suction chamber, a gap (t) between the fixed wrap 323 and the orbiting wrap 332 may occur as the orbiting scroll 33 is pushed. On the other hand, if the actual offset amount is larger than the proper offset amount, a gap between the fixed wrap 323 and the orbiting wrap 332 may occur near the suction chamber. In this case, at an opposite side to the suction chamber, a frictional loss and abrasion may occur due to interference between the fixed wrap 323 and the orbiting wrap 332.

In a case of implementing the proper offset amount at the fixed wrap and the orbiting wrap, the first and second offset portions 323*b*, 332*b* may be formed in a distributed manner with a proper ratio such that the sum of the first and second offset portions 323*b*, 332*b* may satisfy the proper offset amount. In this case, as a thickness of the fixed wrap 323 or the orbiting wrap 332 is prevented from being excessively reduced at the first or second offset portion 323*b*, 332*b*, damage of the fixed wrap or the orbiting wrap may be prevented when the scroll compressor is driven with a high compression ratio.

However, in some cases, the offset portion 323*b* may be formed only at the fixed wrap 323. Alternatively, the offset portion 332*b* may be formed only at the orbiting wrap 332. In the case of forming the offset portion only at one of the two wraps, a wrap thickness of the fixed wrap or the orbiting wrap is reduced, resulting in lowering a reliability when the scroll compressor is driven with a high compression ratio. Hereinafter, a detailed shape of the offset portion will be explained using an example for which the first offset portion is formed at the fixed wrap, and the second offset portion is formed at the orbiting wrap in correspondence to the first offset portion.

As shown in FIG. 9, each of the first and second offset portions 323*b*, 332*b* may be formed in a curved shape, such that an offset amount may be increased towards a central region from two ends thereof. As shown, the central region of the offset portion is positioned on a virtual line (CL) which connects a center (O) of the fixed scroll 32 (or the orbiting scroll) with the suction completion point, which receives the most stress with a largest transformation amount when the fixed scroll 32 is transformed. Thus, a section (or a region) of the fixed wrap 323, which is to be transformed the most, is offset the most, thereby minimizing an interference amount between the fixed wrap 323 and the orbiting wrap 332.

In a case of forming the first offset portion 323*b* or the second offset portion 332*b* in a curved shape, each of the first and second offset portions 323*b*, 332*b* may be formed as a curved surface having one or more curvature radiuses (R2). Here, the curvature radius (R2) of the first offset portion 323*b* may be smaller than a curvature radius (R1) of the fixed wrap 323 at a corresponding position. The second offset portion of the orbiting wrap may be formed vice versa. Although not shown, each offset portion may be formed in a straight shape such that its depth may be constant. In this case, two ends of the offset portion may be formed as a curved surface for slidable contact between the wraps.

Although not shown, each of the first and second offset portions 323*b*, 332*b* may be formed at an entire section of the fixed wrap 323 or the orbiting wrap 332, in a wrap moving direction. In this case, each of the first and second offset portions 323*b*, 332*b* may be formed to have a uniform depth in the wrap moving direction.

However, considering that each of the fixed wrap 323 and the orbiting wrap 332 has a transformation amount increased towards an edge region from a central region in the wrap moving direction, each offset portion may be formed to have a depth increased towards the edge region from the central region. If each offset portion is formed to have a uniform depth, an offset amount may be relatively large at a region having a small transformation amount, resulting in a gap between the two wraps. On the other hand, if the offset amount is relatively small at a region having a large transformation amount, interference between the two wraps results. Thus, an offset amount may be largest at a region having a largest transformation amount, and smallest at a region having a smallest transformation amount. The offset amount is proportionally reduced towards a region having a small offset amount from a region having a large offset amount.

In the case of forming the offset portion on a side surface of the fixed wrap and/or the orbiting wrap where interference between the two wraps occurs as the fixed scroll and/or the orbiting scroll is thermally-transformed, the orbiting scroll may be prevented from being pushed in the radial direction. This may restrict or minimize occurrence of a gap between the fixed wrap and the orbiting wrap, thereby enhancing compression efficiency.

As shown in FIG. 10, the first offset portion 323*b* may be inclined such that a wrap thickness may be reduced from a wrap root (or a wrap intermediate region) of the fixed wrap 323 contacting the first plate portion 321 to a wrap end. On the other hand, the second offset portion 332*b* may be inclined such that a wrap thickness may be reduced from a wrap end to a wrap root of the orbiting wrap.

The first and second offset portions 323*b*, 332*b* may be configured to prevent interference between the fixed wrap 323 near the suction chamber (Vs) and the orbiting wrap 332, due to bending towards a central region. Therefore, the first offset portion 323*b* may be formed on an inner side surface of the fixed wrap 323, and the second offset portion 332*b* may be formed on an outer side surface of the orbiting wrap 332.

This will be explained with an example of an envelope. The envelope means a moving path of the compression chamber. When the envelope is moved to both sides in parallel by an orbiting radius of the orbiting scroll, a shape of an inner side surface of the fixed wrap and an outer side surface of the orbiting wrap is formed, or a shape of an outer side surface of the fixed wrap and an inner side surface of the orbiting wrap is formed.

Figure 11:
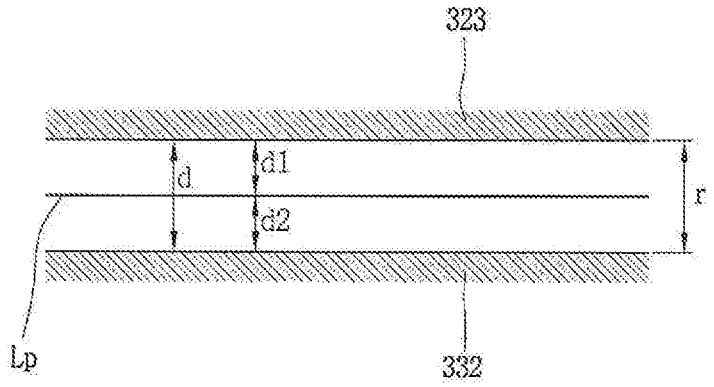
FIG. 11 is a schematic view illustrating a distance between an inner side surface of a fixed wrap and an outer side surface of an orbiting wrap when there is provided no offset portion.
Figure 12:
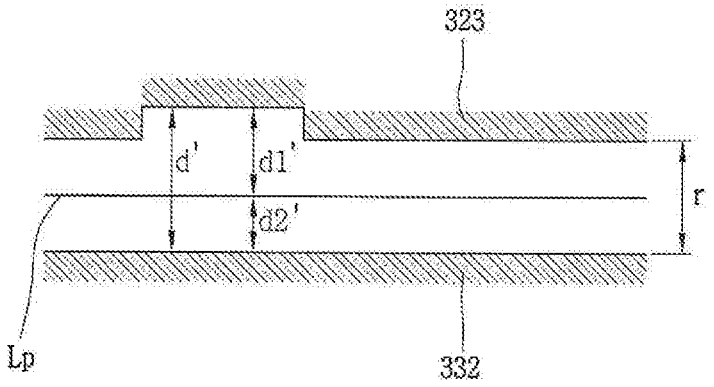
FIG. 12 is a schematic view illustrating a distance between an inner side surface of a fixed wrap and an outer side surface of an orbiting wrap when there is provided an offset portion.

FIG. 11 is a schematic view illustrating a distance between an inner side surface of the fixed wrap and an outer side surface of the orbiting wrap when there is provided no offset portion. FIG. 12 is a schematic view illustrating a distance between an inner side surface of the fixed wrap and an outer side surface of the orbiting wrap when there is provided an offset portion.

As shown in FIG. 11, when there is provided no offset portion, a distance (d) between the two wraps, obtained by adding a distance (d1) from the envelope (Lp) to an inner side surface of the fixed wrap 323, to a distance (d2) from the envelope (Lp) to an outer side surface of the orbiting wrap 332, is the same as an orbiting radius (r). On the other hand, as shown in FIG. 12, when an offset portion is formed at each of the fixed wrap and the orbiting wrap, a distance (d') between the two wraps, obtained by adding a distance (d1') from the envelope (Lp) to an inner side surface of the fixed wrap 323, to a distance (d2') from the envelope (Lp) to an outer side surface of the orbiting wrap 332, is larger than the orbiting radius (r). The same applies to a case in which the offset portion is formed only at the fixed wrap.

A transformation amount of the fixed wrap 323 may be different from a transformation amount of the orbiting wrap 332. In this case, offset amounts of the first and second offset portions 323*b*, 332*b* may be different from each other within a range which satisfies a proper offset amount.

In this case, an offset amount of the first offset portion 323*b* may be larger than an offset amount of the second offset portion 332*b*. That is, in this embodiment, as a wrap end of the fixed wrap 323 and a wrap end of the orbiting wrap 332 are bent towards a central region, an edge of an inner side surface of the fixed wrap 323 may interfere with a wrap root of the orbiting wrap 332. As a wrap root of the fixed wrap 323 does not contact a wrap end of the orbiting wrap 332 (more precisely, a side surface of a wrap end), the first offset portion 323*b* may be formed only at an edge of an inner side surface of the fixed wrap 323. Accordingly, the fixed wrap 323 may maintain its thickness at a root thereof, resulting in enhanced reliability even when the scroll compressor is driven with a high compression ratio. On the other hand, as the wrap end of the fixed wrap 323 contacts the wrap root of the orbiting wrap 332, the second offset portion 332*b* should be formed up to an end of the wrap root, that is, a region at which the wrap and the plate portion meet, or a neighboring region. In this case, as a wrap thickness of the orbiting wrap 332 may be reduced at the wrap root, the offset amount of the first offset portion 323*b* may be larger than the offset amount of the second offset portion 332*b*.

With such a configuration, in the fixed scroll according to this embodiment, even if the plate portion is thermally transformed (elongated in the radial direction) by being heated by a high-temperature refrigerant discharged to the inner space of the discharge cover, a wrap thickness of the fixed wrap is reduced at a section having the largest stress. This may prevent interference between the fixed wrap and the orbiting wrap at a corresponding section to a maximum. This may prevent refrigerant leakage through a gap formed between the fixed wrap and the orbiting wrap at an opposite side to a suction side, due to a partial interference therebetween.

Figure 13:
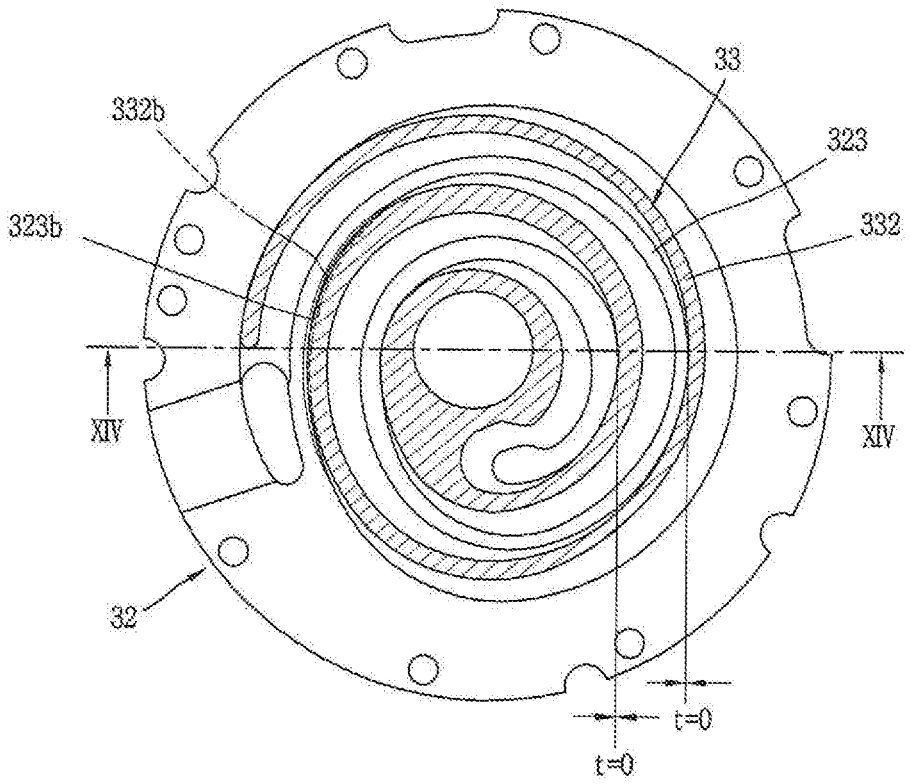
FIG. 13 is a planar view illustrating a coupled state of a fixed scroll and an orbiting scroll each having an offset portion according to an embodiment.
Figure 14:
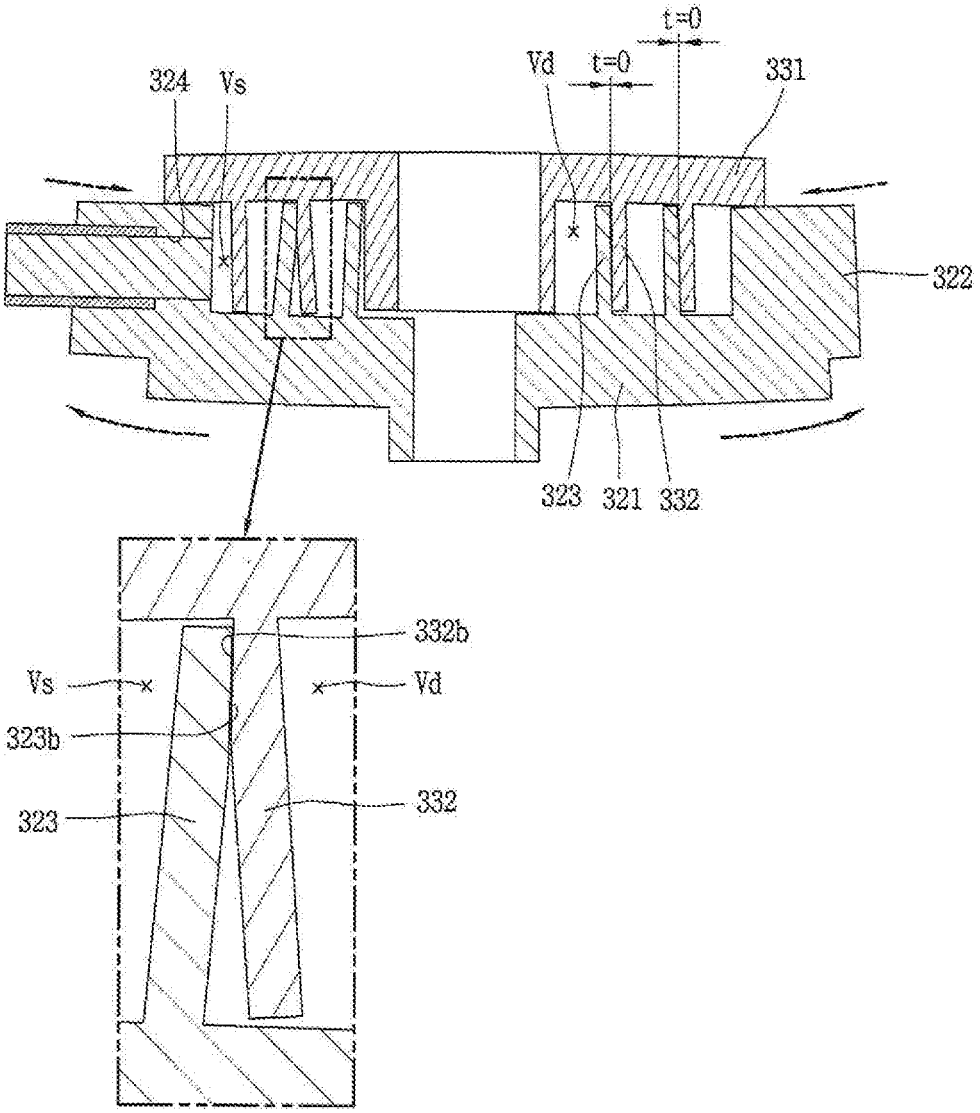
FIG. 14 is a sectional view taken along line 'XIV-XIV' in FIG. 13.

FIG. 13 is a planar view illustrating a coupled state of the fixed scroll and the orbiting scroll each having the offset portion according to an embodiment. FIG. 14 is a sectional view taken along line 'XIV-XIV' in FIG. 13. As shown, when an inlet 324 is formed (on the left side in the drawing), an end of the fixed wrap 323 is greatly bent (to the right side in the drawing) at a section of the fixed wrap 323 adjacent to the inlet 324. This may cause the end of the fixed wrap 323 to interfere with a root of the orbiting wrap 332.

However, if the first and second offset portions 323*b*, 332*b* are formed on a side surface of the fixed wrap 323 (the right side surface in the drawing) and a side surface of the orbiting wrap 332 (the left side surface in the drawing), respectively, in reverse shapes, interference between the fixed wrap 323 and the orbiting wrap 332 may be prevented. This may prevent the orbiting scroll 33 from being moved (to the right side in the drawing). As a result, the fixed wrap 323 and the orbiting wrap 332 do not have a gap therebetween (on the right side in the drawing). Even if the fixed wrap 323 and the orbiting wrap 332 are spaced from each other, a spacing distance therebetween may be minimized, and thus, leakage of a compressed refrigerant may be minimized.

Another embodiment of the first and second offset portions will be explained hereinafter.

In the aforementioned embodiment, the first offset portion or both of the first and second offset portions are formed to be inclined from a wrap root to a wrap end. However, in this embodiment, the first and second offset portions may be respectively formed at the wrap end and the wrap root, with a stair-step shape, with consideration of processability.

Figure 15:
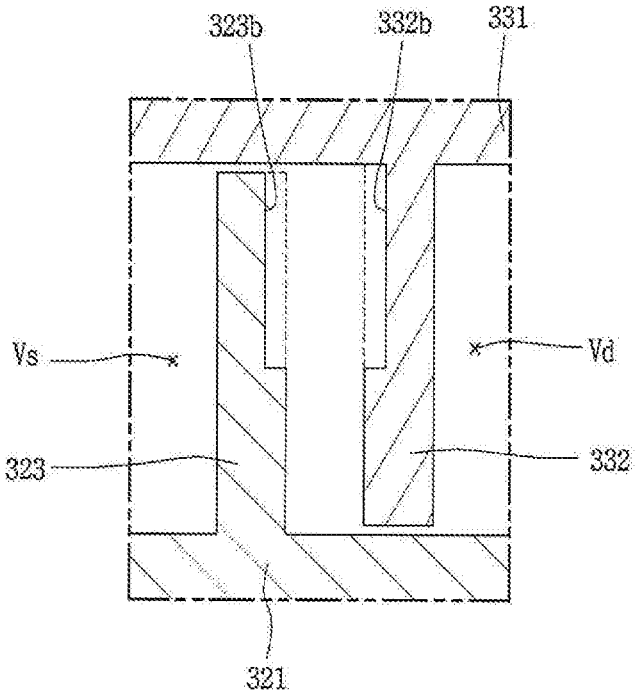
FIGS. 15 and 16 are longitudinal sectional views illustrating offset portions according to other embodiments.

For example, as shown in FIG. 15, the first offset portion 323*b* may be formed at an edge of an inner end of the fixed wrap 323, in a stair-step shape. On the other hand, the second offset portion 332*b* may be formed at a wrap root outside of the orbiting wrap 332, in the form of a groove with a stair-step shape.

In this case, a proper offset amount may be the same as the proper offset amount of the aforementioned embodiment, and a basic configuration and effects may be similar to those of the aforementioned embodiment. Thus, detailed explanations thereof has been omitted. In this embodiment, as the first offset portion 323*b* is formed at an edge of the wrap end of the fixed wrap 323, the fixed wrap 323 may be easily processed. Further, the orbiting wrap 332 may have an enhanced processability, as a processing of the second offset portion 332*b* is easier than the aforementioned inclined processing.

In a case of forming the first offset portion 323*b* on an entire region of a side surface of the fixed wrap 323 according to the aforementioned embodiment, a wrap thickness of the fixed wrap 323 may be generally reduced, resulting in a low intensity of the fixed wrap 323. However, in a case of forming the first offset portion 323*b* on the wrap end of the fixed wrap 323 according to this embodiment, the fixed wrap 323 may maintain its wrap thickness at the wrap root. This may allow the fixed wrap 323 to maintain its intensity, resulting in obtaining reliability.

Still another embodiment of the first and second offset portions will be explained hereinafter.

In the aforementioned embodiments, each of the fixed wrap and the orbiting wrap is formed such that a sectional area at a wrap end is different from a sectional area at a wrap root. However, in this embodiment, an offset portion is formed such that a sectional area at a wrap end is the same as a sectional area at a wrap root.

Figure 16:
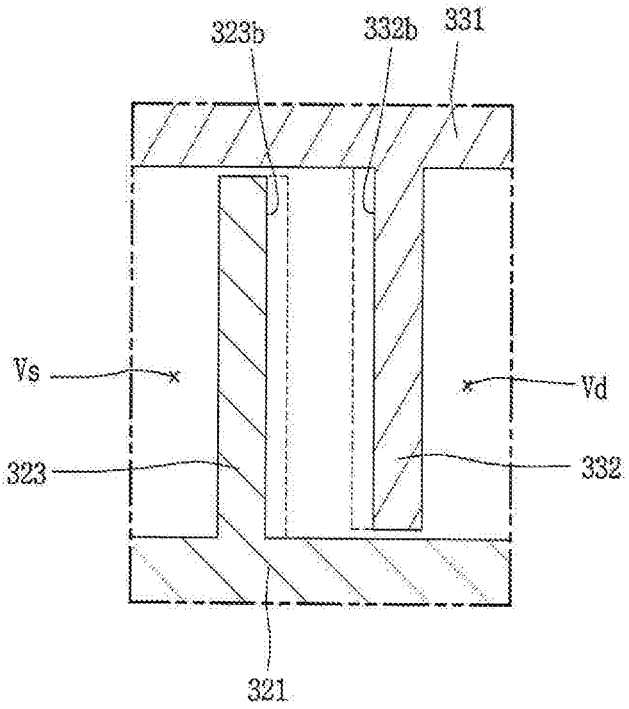

For example, as shown in FIG. 16, the first offset portion 323*b* may be formed on an inner side surface of the fixed wrap 323, and the second offset portion 332*b* may be formed on an outer side surface of the orbiting wrap 332. In this case, each of the first and second offset portions 323*b*, 332*b* may be formed such that a sectional area at a wrap end may be the same as a sectional area at a wrap root.

Accordingly, at remaining regions of the fixed wrap 323 and the orbiting wrap 332 except for the first and second offset portions 323*b*, 332*b*, a sectional area of the wrap end may be the same as a sectional area of the wrap root. In this case, the first and second offset portions 323*b*, 332*b* may be easily processed as they are processed in a direction perpendicular to the wraps. The first offset portion 323*b* of the fixed wrap 323 may be formed with a stair-step shape, by cutting only an edge of the wrap end.

A configuration and effects according to this embodiment are similar to those according to the aforementioned embodiments, and thus, detailed explanations thereof have been omitted. In this embodiment, a processing error may be minimized due to a simple processing.

Embodiments disclosed herein provide a scroll compressor capable of preventing a compression loss due to leakage of a compressed refrigerant, the compression loss occurring as a fixed wrap and an orbiting wrap are spaced from each other. Embodiments disclosed herein further provide a scroll compressor capable of preventing an orbiting scroll from being pushed by preventing a thermal transformation of a specific part or portion of a fixed wrap. Embodiments disclosed herein also provide a scroll compressor capable of preventing a frictional loss or abrasion between a fixed scroll and an orbiting scroll, due to an excessive contact between a fixed wrap and an orbiting wrap at a specific part or portion.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. An offset portion may be formed to reduce a wrap thickness of the fixed wrap near the inlet.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. At least part of a wrap thickness decrease region of the fixed wrap or the orbiting wrap may be included within a range, from a point where the inlet starts to a suction completion point on the basis of a center of the fixed scroll, the suction completion point formed on an inner side surface of the fixed wrap and where suction at the compression chamber is completed.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. An offset portion having a predetermined depth in a radial direction may be formed on an inner side surface of the fixed wrap which faces the inlet.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. An edge of an inner side surface of the fixed wrap near the inlet may be chamfered.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. An inner side surface of the fixed wrap near the inlet may be formed as a curved surface having a smaller curvature radius than other parts or portions.

Embodiments disclosed herein provide a scroll compressor that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap In a state where the orbiting scroll and the fixed scroll are concentric with each other, when a distance between the two wraps is defined as an orbiting radius, there exists an offset section having an interval larger than the orbiting radius, between a side surface of the orbiting wrap and a side surface of the fixed wrap which faces the side surface of the orbiting wrap. At least part of the offset section may be overlapped with a section which forms the suction chamber. A wrap thickness within the offset section may be smaller than a wrap thickness out of the offset section.

Embodiments disclosed herein provide a scroll compressor that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap. An offset portion may be formed on a side surface of at least one of the fixed wrap or the orbiting wrap so as to have a distance between the two wraps greater than an orbiting radius defined as a distance between the two wraps in a concentric state between the orbiting scroll and the fixed scroll. The offset portion may be formed on one side surface of the fixed wrap, opposite to another side surface of the fixed wrap which forms the suction chamber. The offset portion may be formed such that at least a part thereof may be included between two virtual lines which connect a center of the fixed scroll with two ends of a section which forms the suction chamber.

When one side surface of the fixed wrap which is towards a center of the fixed scroll is defined as an inner side surface and another side surface opposite to the one side surface is defined as an outer side surface, the offset portion may be formed on the inner side surface of the fixed wrap. When one side surface of the orbiting wrap which is towards a center of the orbiting scroll is defined as an inner side surface and another side surface opposite to the one side surface is defined as an outer side surface, the offset portion may be formed on the outer side surface of the orbiting wrap.

The offset portion may be formed such that its depth may be increased towards a central region from two ends thereof in a wrap moving direction. The offset portion may be formed as a curved surface having one or more curvature radiuses. The curvature radius of the offset portion may be smaller than a curvature radius of the wrap.

The fixed wrap at a section where the offset portion is formed, may have a sectional area decreased towards a wrap end from a wrap root or a region near the wrap root. The orbiting wrap at a section where the offset portion is formed, may have a sectional area increased towards a wrap end from a wrap root. The fixed wrap at a section where the offset portion is formed, may have a stair-step at an edge of a wrap end thereof.

The orbiting wrap at a section where the offset portion is formed, may have a groove having a predetermined depth near a wrap root. The fixed wrap or the orbiting wrap at a section where the offset portion is formed, may be formed to have the same sectional area from a wrap root to a wrap end. An offset amount of the offset portion may be calculated by a formula, [a thermal expansion coefficient of the scroll×a distance from a center of the scroll to a side surface of a corresponding wrap×a temperature difference between a suction refrigerant and a discharge refrigerant].

Embodiments disclosed herein provide a scroll compressor that may include a casing; a drive motor provided at an inner space of the casing; a rotational shaft coupled to a rotor of the drive motor, and rotated together with the rotor; a frame installed or provided below the drive motor; a fixed scroll provided below the frame, having an inlet and an outlet, and having a fixed wrap; an orbiting scroll provided between the frame and the fixed scroll, and having an orbiting wrap which forms a compression chamber including a suction chamber, an intermediate pressure chamber, and a discharge chamber, by being engaged with the fixed wrap, the orbiting scroll having a rotational shaft coupling portion to couple the rotational shaft in a penetrating manner; and a discharge cover coupled to a lower side of the fixed scroll, and configured to accommodate the outlet therein in order to guide a refrigerant discharged through the outlet to the inner space of the casing. In a state where the orbiting scroll and the fixed scroll are concentric with each other, when a distance between the two wraps is defined as an orbiting radius, there exists an offset section having an interval larger than the orbiting radius, between a side surface of the orbiting wrap and a side surface of the fixed wrap which faces the side surface of the orbiting wrap, and at least a part or portion of the offset section is overlapped with a section which forms the suction chamber.

The offset section may be formed such that at least a part or portion thereof may be positioned within a range of about ±30° (crank angle), on the basis of a suction completion point formed on an inner side surface of the fixed wrap and where suction at the compression chamber is completed. An offset amount at the offset section may be calculated by a formula, [a thermal expansion coefficient of the scroll×a distance from a center of the scroll to a side surface of a corresponding wrap×a temperature difference between a suction refrigerant and a discharge refrigerant].

The compression chamber may include a first compression chamber formed on an inner side surface of the fixed wrap, and a second compression chamber formed on an outer side surface of the fixed wrap. The first compression chamber may be defined between two contact points P11 and P12 generated as the inner side surface of the fixed wrap contacts an outer side surface of the orbiting wrap. A formula of $0°<\alpha<360°$ may be formed, where a is an angle defined by two lines which connect a center O of the eccentric portion to the two contact points P1 and P2, respectively.

In the scroll compressor according to embodiments disclosed herein, as the offset portion concaved by a predetermined depth is formed on a side surface of the fixed wrap and/or the orbiting wrap at a section which forms the suction chamber, interference between the fixed wrap and the orbiting wrap at a specific part or portion may be prevented. This may prevent leakage of a compressed refrigerant, occurring at an opposite side (180°) to the suction chamber to the suction chamber as the fixed wrap and the orbiting wrap are spaced from each other.

Further, as interference between the fixed wrap and the orbiting wrap at a specific part or portion due to a thermal transformation of the fixed wrap is prevented, an excessive contact between the fixed wrap and the orbiting wrap at the specific part may be prevented. This may reduce a frictional loss, or abrasion of the fixed scroll or the orbiting scroll, thereby enhancing a reliability of the scroll compressor.

Further scope of applicability of the present application will become more apparent from the detailed description given. However, it should be understood that the detailed description and specific examples, while indicating embodiments, are given by way of illustration only, since various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

a drive motor provided in an inner space of the casing;

a rotational shaft coupled to the drive motor to rotate;

an orbiting scroll comprising an orbiting plate portion including a shaft coupling portion coupled to the rotational shaft, and an orbiting wrap that extends toward the casing along a circumference of the orbiting plate portion in the shaft coupling portion;

a fixed scroll comprising a fixed wrap provided in engagement with the orbiting wrap to compress a refrigerant, a fixed plate portion including an inlet that receives the refrigerant, and an outlet spaced apart from the inlet toward the shaft coupling portion to discharge the refrigerant; and an offset portion provided in an area of at least one of the fixed wrap or the orbiting wrap to enlarge a distance between the fixed wrap and the orbiting wrap, wherein the offset portion is formed within a range of +−30 degrees from the rotational shaft with respect to the inlet, and wherein the offset portion is not provided at a region between the rotational shaft and an opposite side to the inlet.

2. The compressor according to claim 1, wherein the offset portion is provided closer to the inlet than the rotational shaft.

3. The compressor according to claim 1, wherein the offset portion is provided in a region in which at least one of the fixed wrap or the orbiting wrap extends from the inlet toward the shaft coupling portion.

4. The compressor according to claim 1, wherein the offset portion is provided on at least one surface of the fixed wrap or the orbiting wrap, and the offset portion is provided along a direction extending from the inlet toward the shaft coupling portion.

5. The compressor according to claim 1, wherein the offset portion is provided at a free end of the fixed wrap and a fixed end of the orbiting wrap.

6. The compressor according to claim 1, wherein the offset portion is provided on at least one of an inner surface of the fixed wrap and an outer surface of the orbiting wrap facing the inner surface.

7. The compressor according to claim 6, wherein the offset portion is provided on the inner surface of the fixed wrap and the outer surface of the orbiting wrap, respectively.

8. The compressor according to claim 6, wherein the offset portion is formed by recessing an inner surface of the fixing wrap, and the offset portion is formed such that the outer surface of the orbiting wrap is biased toward the shaft coupling portion.

9. The compressor according to claim 1, wherein offset portion provided is provided in a convex shape toward the casing.

10. The compressor according to claim 9, wherein the offset portion has a variable depth along an extending direction of the fixed wrap or the orbiting wrap.

11. The compressor according to claim 9, wherein the offset portion is provided so as to decrease in depth after increasing in depth along an extending direction of the fixed wrap or the orbiting wrap.

12. The compressor according to claim 1, wherein the offset portion extends further inward from the inlet by an area corresponding to a width of the inlet at the free end of the orbiting wrap.

* * * * *